US007044351B2

(12) United States Patent
Ronconi

(10) Patent No.: US 7,044,351 B2
(45) Date of Patent: May 16, 2006

(54) MODULAR MAGAZINE OF FIXING ELEMENT FOR PNEUMATIC GUN

(75) Inventor: Marco Ronconi, Bologna (IT)

(73) Assignee: Fasco S.p.A., Bologna (IT)

( * ) Notice: Subject to any disclaimer, the term of this patent is extended or adjusted under 35 U.S.C. 154(b) by 0 days.

(21) Appl. No.: 10/838,062

(22) Filed: May 3, 2004

(65) Prior Publication Data

US 2005/0242152 A1 Nov. 3, 2005

(51) Int. Cl.
*B25C 1/04* (2006.01)

(52) U.S. Cl. ..... 227/123; 227/127

(58) Field of Classification Search ..... 227/18, 227/109, 120, 123, 127, 128
See application file for complete search history.

(56) References Cited

U.S. PATENT DOCUMENTS 2,746,043 A * 5/1956 Zaller ..... 227/127
3,207,405 A * 9/1965 Langas et al. ..... 227/125
3,612,383 A * 10/1971 Perkins et al. ..... 227/125
4,225,075 A * 9/1980 Chi ..... 227/119
4,927,067 A * 5/1990 Leszczak ..... 227/128
5,009,356 A * 4/1991 Chang ..... 227/120
5,884,829 A * 3/1999 Wingert ..... 227/151
5,899,374 A * 5/1999 Chen ..... 227/120
6,062,457 A * 5/2000 Huang ..... 227/134
6,082,604 A * 7/2000 Dennis ..... 227/8
6,173,877 B1 * 1/2001 Wingert ..... 227/109
6,715,657 B1 * 4/2004 Chen ..... 227/120

* cited by examiner

*Primary Examiner*—Stephen F. Gerrity
*Assistant Examiner*—Paul Durand
(74) *Attorney, Agent, or Firm*—William J. Sapone; Coleman Sudol Sapone, P.C.

(57) ABSTRACT

An improved modular magazine of fixing elements for a pneumatic gun (100) comprises an elongated casing (2), which is parallelepiped shaped and internally hollow, fit to be removably coupled to the pneumatic gun (100). The casing (2) has, at one end, a first flat and elongated head (14), the remaining end being open, and it has, at one of the lateral surfaces, a longitudinal opening (10) through which an inner support (3) of fixing element (90) can be slidingly inserted within said casing (2) in an assembled condition (A) of magazine (1). The inner support (3) includes a guide (8) fit for slidably housing the fixing element (90); a pusher (4) for said fixing elements (90) movable on said guide (8); a second flat and elongated head (5) fixed to an end of guide (8), fit for mating in the assembled condition (A) the first head (14); an engagement element (6) fixed to the remaining end of guide (8) for locking the inner support (3) to the pneumatic gun (100). The guide (8) includes at least an elongated base element (27) and a supporting rib (28) which is provided with a supporting portion (27*b*) fit for housing corresponding fixing elements (90) with predefined size. The supporting rib (28), the second head (5) and the engagement element (6) are removably coupled to said base element (27), while the first head (14) is removably coupled to the casing (7).

23 Claims, 5 Drawing Sheets

MODULAR MAGAZINE OF FIXING ELEMENT FOR PNEUMATIC GUN

BACKGROUND OF THE INVENTION

1. Field of the Invention

The present invention relates to pneumatic nail o staple gun and more particular to an improved modular magazine of fixing element for pneumatic gun capable to be easily assembled for accommodating different type of fixing element.

2. Description of Related Art

There are known magazines for pneumatic guns which are substantially constituted by an elongated casing that is rigidly coupled to the body of the gun, is internally hollow and is open at both ends and on one of its lateral surfaces. This casing can accommodate a guide, which slides therein along suitable longitudinal slots. The guide constitutes a supporting base for the fixing elements, such as staples, which are arranged in such a way to straddle a suitable rib and can be expelled by a pneumatically actuated striker.

Document EP-A-1 325 795 of the same applicant of the present application discloses for instance a magazine of fixing elements per pneumatic gun wherein the casing comprises a first flat and elongated head, arranged orthogonal with respect to the casing and provided with a longitudinal incision that has the same width as the fixing elements.

One of the guide ends is provided with a similar second flat and elongated head, which in the operating condition when the guide is fully inserted in the casing, mates the first head so forming a sort of chamber, defined by the longitudinal incision of first head and by the surface of second head. Such chamber is the firing chamber or channel of the fixing elements.

The guide is also provided, at the opposite end of the head, with an element fit for locking the guide in the operating position.

The second head, the engagement element and the rib are usually in single body, mutually connected by welding. In document EP-A-1 325 795 for instance only the guide, comprising a lamina and a rib, is monolithically formed by drawing aluminium alloy.

In both case, in case of damage or breaking of guide portions, due to the intense stresses of magazine during operation, it is necessary to replace the entire guide.

Moreover, the operation of the conventional pneumatic gun involving different type of fixing elements is troublesome, since it is necessary for fixing elements having a different shape or different dimensions it is necessary to use another guide, with different dimension and shape of head and rib.

The cost associated with purchasing, storing and maintaining different type of magazine and spare magazine is an economic burden for the user.

SUMMARY OF THE INVENTION

To overcome the above drawbacks, the present invention intends to provide an improved modular magazine of fixing elements for pneumatic gun that allows replacing easily any damaged parts of the guide without having to resort to a new guide.

Similarly, another object of the present invention is to provide an improved modular magazine that allows replacing easily and quickly the size parts whose dimensions and geometries are variable according to the dimensions of such elements, in order to assemble a guide and a magazine fit for several different type of fixing element.

Another object of the present invention is to provide a magazine that is simple, relatively easy to be built and to be assembled and with a relatively low cost.

BRIEF DESCRIPTION OF THE DRAWINGS

These and other objects of the invention will become more from the following detailed description of a preferred but not exclusive embodiment of an improved magazine of fixing elements for pneumatic gun according to the invention, illustrated by way of example in the accompanying drawings, wherein.

DETAILED DESCRIPTION OF PREFERRED EMBODIMENT

Figure 1:
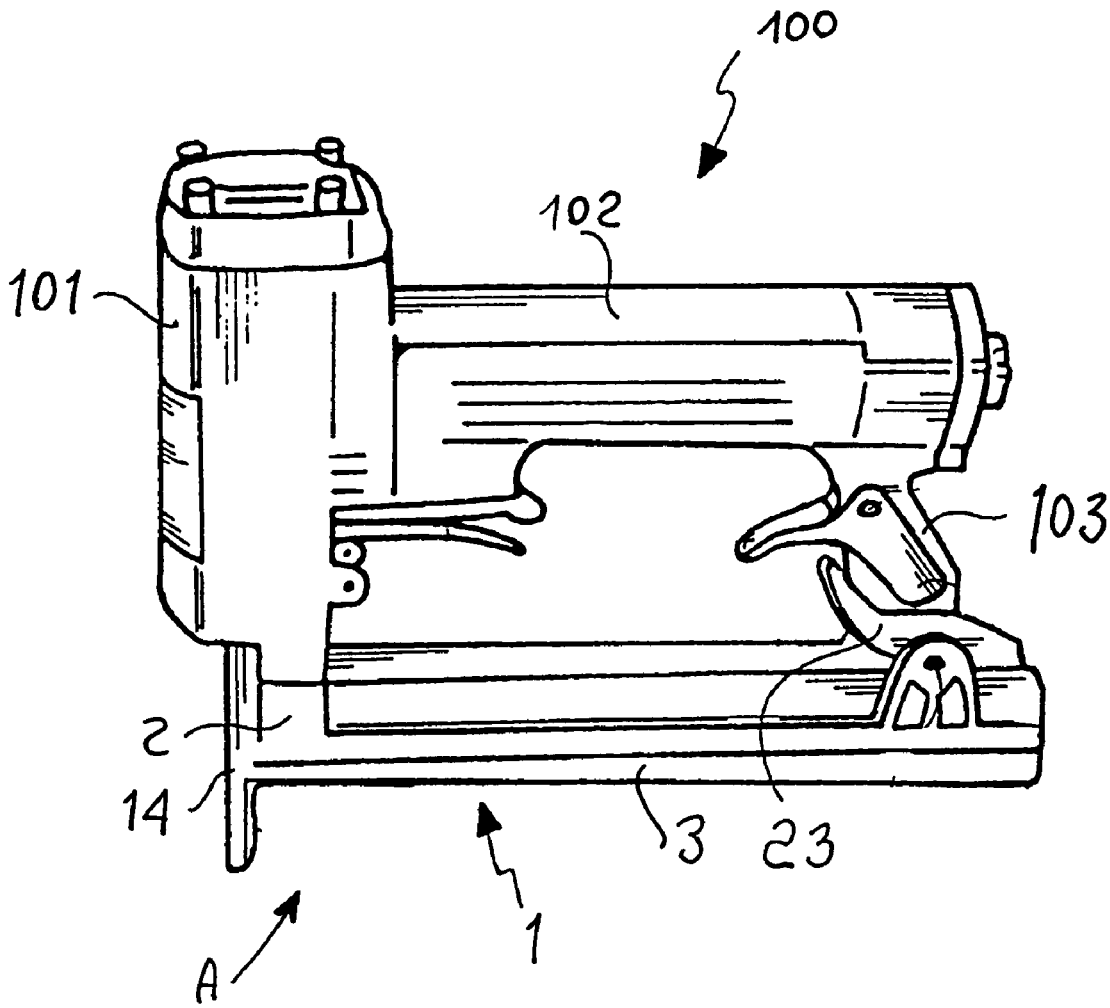
FIG. 1 is a perspective view of a pneumatic gun with the magazine according to the invention.
Figure 2:
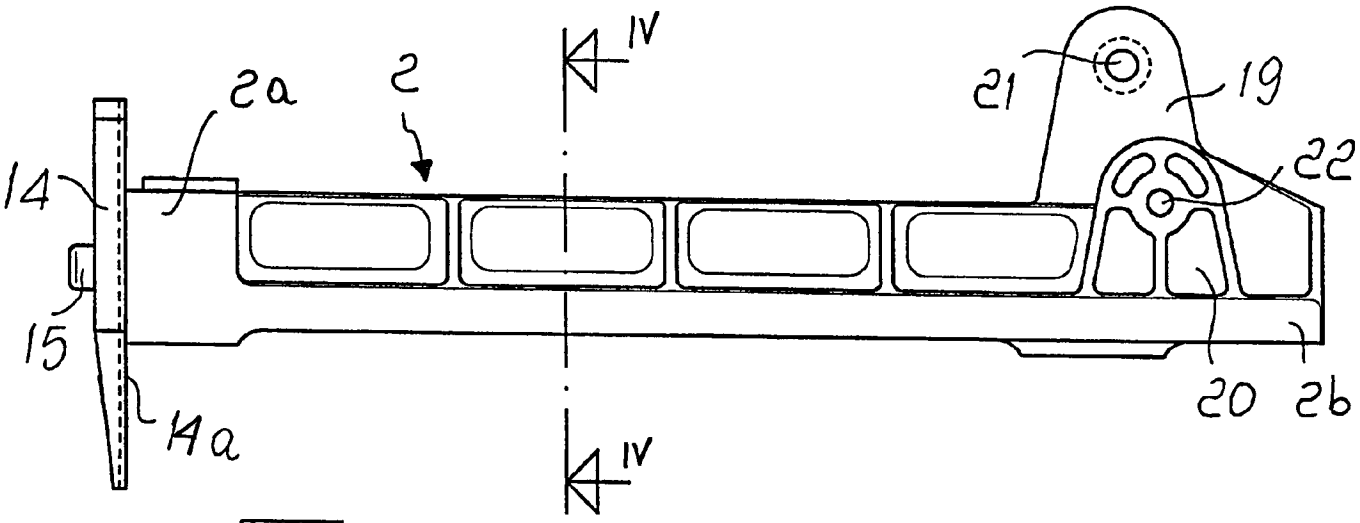
FIG. 2 is a side elevation view of a casing of the magazine.
Figure 3:
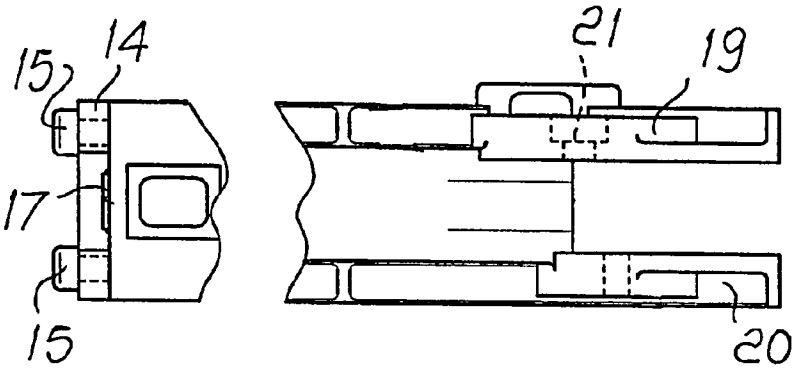
FIG. 3 is a partial plan view of the casing of the magazine.
Figure 4:
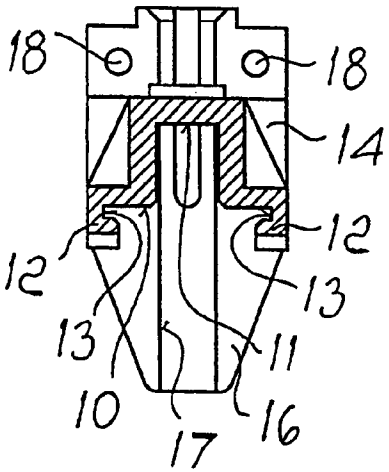
FIG. 4 is a section view along the line IV—IV of FIG. 2.
Figure 5:
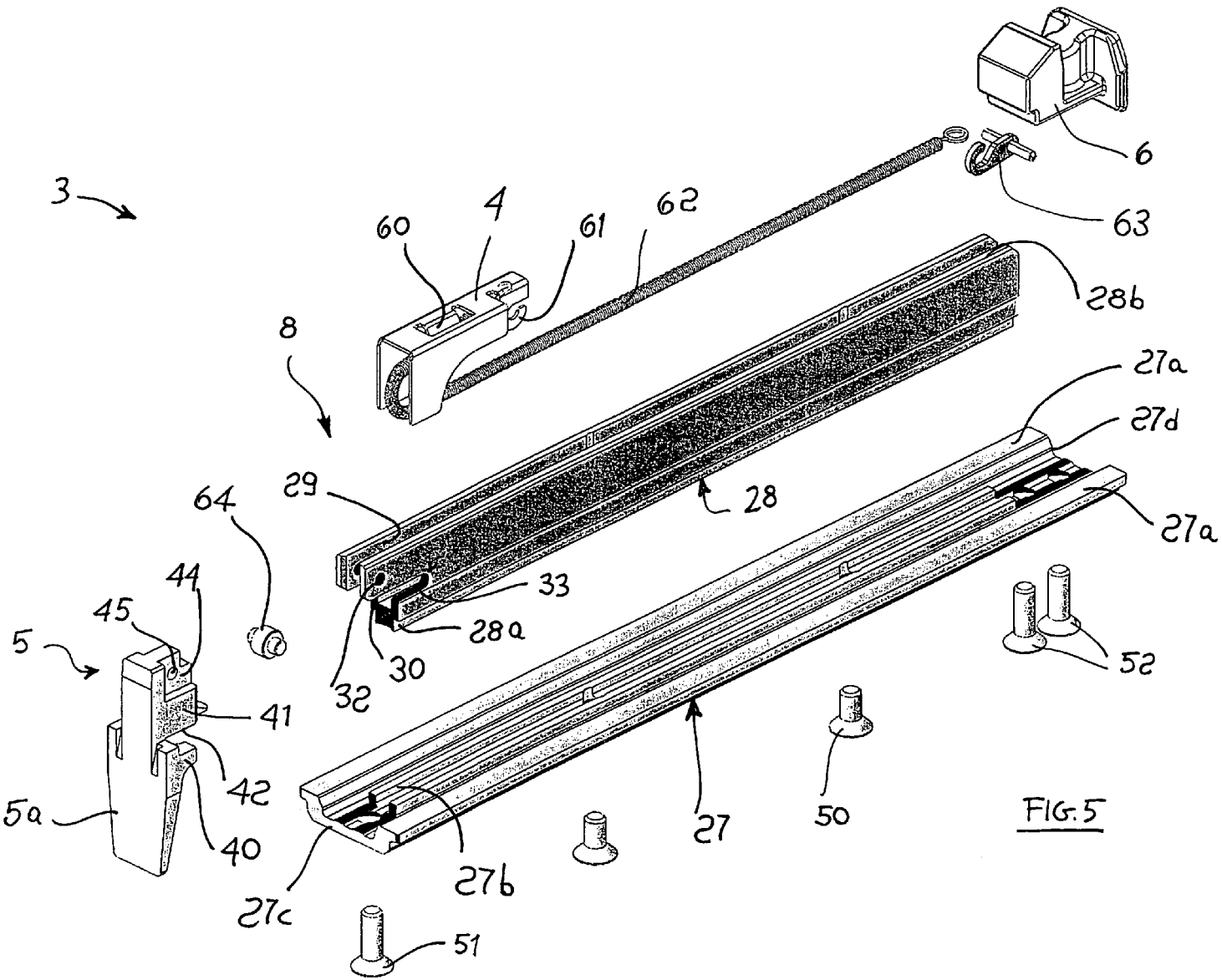
FIG. 5 is a perspective exploded view of a inner support of magazine.
Figure 6:
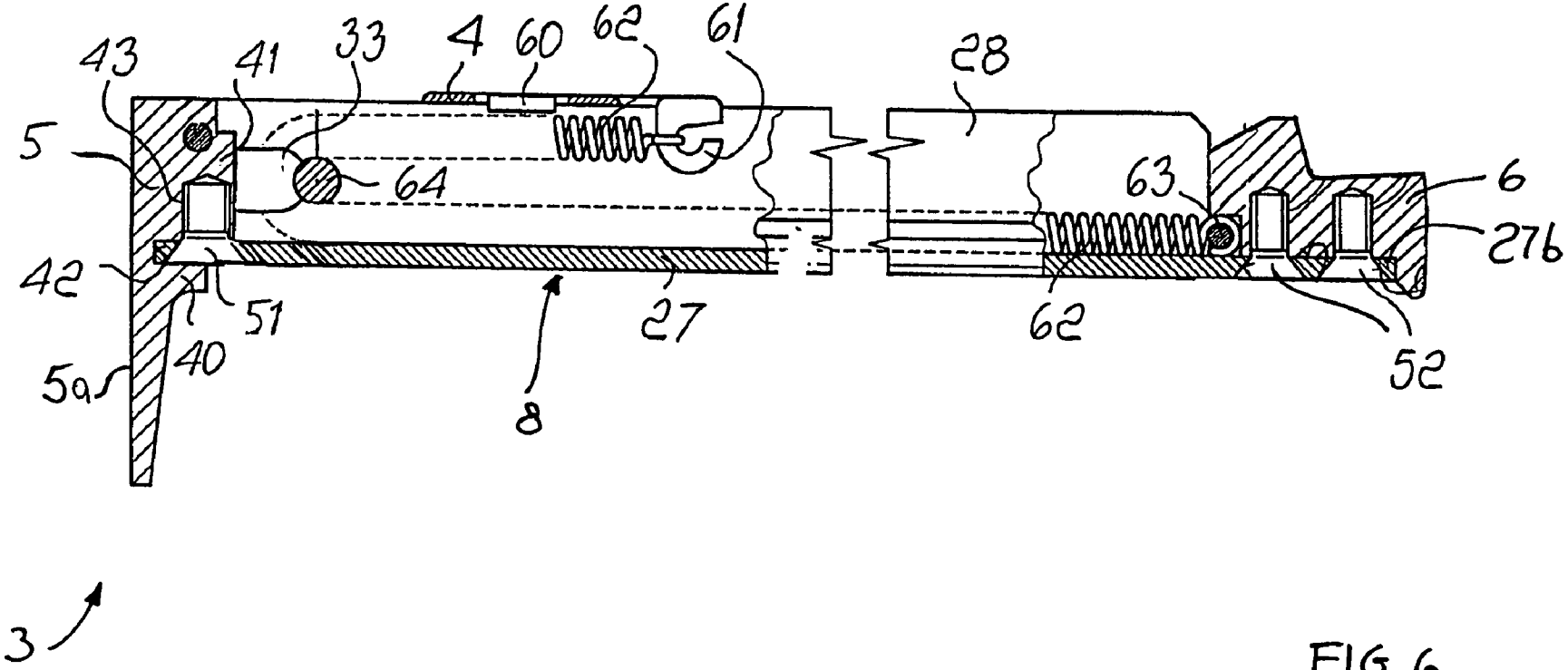
FIG. 6 is a partial section view of the inner support of FIG. 5.
Figure 7:
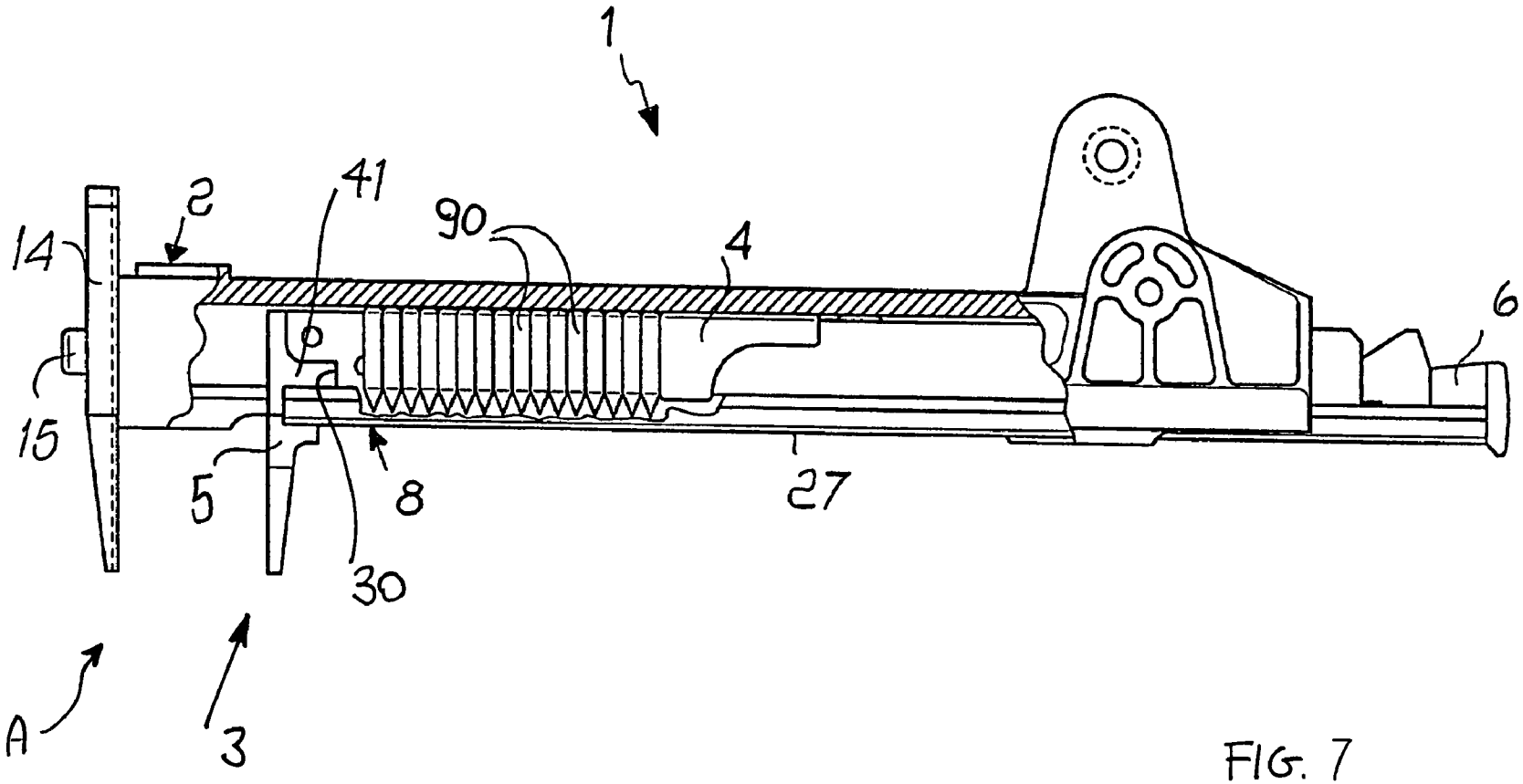
FIG. 7 is a partially sectional side elevation view of the magazine with the inner support partially inserted.

With reference to the FIGS. 1 to 7, the reference numeral 1 generally designates an improved modular magazine of fixing elements 90 for a pneumatic gun 100.

The magazine 1 is composed of a casing 2, in which an inner support 3 of fixing elements 90 can slide in an assembled condition A of magazine 1. The gun 100, in a known manner, includes a body 101, which accommodates a pneumatically actuated striker, and a grip 102, almost orthogonal to the body 101 of the gun and provided with an arm 103 that protrudes from the free end of said grip. The magazine is fixed to the body 101 of the gun 100 at one end and to the arm 103 at the other end.

The casing 2 is substantially shaped like an elongated parallelepiped, is internally hollow and open at both ends, optionally with external lightening recesses and transverse reinforcement ribs. On one of the lateral surfaces of the casing 2 a longitudinal opening 10 is provided, that runs along the casing 2 from one end to the other. The opening 10 has an inner groove 11 with rectangular cross-section, which penetrates until it skims the opposite lateral surface. The edges 12 of the opening 10 have respective slots 13, which are parallel to the bottom of the groove 11 and are arranged symmetrically with respect to it. The slots 13 run along the entire length of the casing 2. At one of the ends 2*a* of the casing 2 there is coupled almost orthogonally a first head 14, which has substantially a trapezoidal, elongated and flat shape. An inner face 14*a* of the first head 14, which faces the casing 2, has a flat incision 17 whose width corresponds to the width of the fixing elements 90 and runs along the entire length of the head.

In a know manner, the head 14 is provided with holes 18 for fixing the casing 2 to the body of the gun 2 and, on the other end 2*b*, the casing 2 forms lugs first 19 and second 20, with respective eye first 21 and second 22, which are suitable respectively to connect the casing 2 to the arm 103 and to locks the inner support 3 within the casing 2, by means of detachable connecting elements such as, for instance, a pawl-like lever 23 that is pivoted in the second eye 22.

According to the invention, the inner support 3 includes a guide 8 fit for slidably support the fixing elements 90 and a pusher 4 for said fixing element 90 movable along the guide 8. The latter comprises a base element 27, which is equal in length to the casing 2, and a supporting rib 28, having a supporting portion 28*b* fit for housing corresponding fixing elements 90 of predefined size. The base element 27 is provided with a longitudinal seat 27*b* fit for accommodating a complementary longitudinal protruding portion 28*a* of supporting rib 28. The base element 27 further has folded longitudinal edges, forming two longitudinal fins 27*a*, fit to be inserted in the corresponding slot 13 of opening 10 of casing 2 in the assembled condition A of magazine 1.

The supporting portion 28*b* is provided with a longitudinal slit 29 that crosses it from one end to the other and it is provided with a recess 30, carried out in correspondence of an end thereof. The inner support 3, according to the invention, includes a second flat and elongated head 5 and an engagement element 6, which are coupled to the opposed ends 27*c*, 27*d* of the base element 27.

The second flat and elongated head 5 forms with its external surface 5*a*, which lies in contact with the inner face 14*a* of first head 14 in the assembled condition A, a firing channel 17*a* together with the flat incision 17.

The second head 5 has a first projection 40 and a second projection 41 orthogonally protruding and forming therebetween a slit 42. The second projection 41 forms a narrower region 44 on which there is a through hole 45. In the interlocking between the supporting rib 28 and the second head 5, the projection 41, in its widest portion, enters the complementary recess 30 of rib 28 and the hole 45 is aligned with an opening 32 of rib 28 for the passage of an interconnecting pin.

The engagement element 6 is fit for locking the inner support 3, and thus the magazine 2, to the arm 103 by means of detachable connecting elements.

Supporting rib 28, second head 28 and engagement element 6 are removably coupled to the base element 27 by fixing means such as screws 50, 51, 52. Likewise, the first head 14 is removably coupled to elongated casing 7 by fixing means such as screws 15.

The pusher 4 can slide on the supporting portion 28*b* and is preferably constituted by a U-shaped folded metal plate, in the concavity of which said supporting portion is inserted. The pusher may include a stroke limiter element 60 and a hook 61. The pusher is arranged on the supporting portion 28*a* so that the hook 61 is directed toward the end 8*b* of guide 8.

In the assembled condition A the pusher 4 is biased towards the second head 5 by elastic means 62 connected to the engagement element 6 and housed in the slit 29 of the supporting rib 28. More particularly, the elastic means 62 comprise a traction spring, which is fixed at its opposed ends respectively to the hook 61 of pusher 4 and to hook means 63, interposed between the supporting rib 28 and the engagement element 6. The traction spring 62 is wound on a guiding wheel 64, which engages a slot 33 carried out on the supporting rib 28.

In a variant of the modular magazine of fixing elements, not shown in the figures, the longitudinal protruding portion 28*a* of supporting rib 28 and the longitudinal seat 27*b* of base element 27 have complementary shaped sections in order to form a dap joint, such as a dovetail joint. In this way, the supporting rib 28 can be slidingly inserted in the base element 27 and then it can be removably locked to the base element 27 by means of the engagement element 6 and the first head 14 coupled thereto.

It has thus been shown that the invention achieves the intended objects. In particular, the removable mutual coupling of the components of magazine 1 allows an easy and quick replacement of said components both in case of their damage and in case the operation of pneumatic gun involves different type of fixing elements. In this case, the magazine design according to the present invention allowing changing the heads, first 14 and second 5, and the supporting rib 29, so making possible to adapt the magazine 1 to accommodate fixing elements having a different shape or different dimensions without the need to change the all magazine.

The invention thus conceived is susceptible of numerous modifications and variations, all of which are within the scope of the inventive concept.

All the details may further be replaced with other technically equivalent ones.

Where technical features mentioned in any claim are followed by reference signs, those reference signs have been included for the sole purpose of increasing the intelligibility of the claims and accordingly such reference signs do not have any limiting effect on the scope of each element identified by way of example by such reference signs.

What is claimed is:

1. An improved modular magazine of fixing elements for a pneumatic gun (100), comprising an elongated casing (2), which is parallelepiped shaped and internally hollow, fit to be removably coupled to the pneumatic gun (100); the casing (2) has, at one end, a first flat and elongated head (14), the remaining end being open, and at one of the lateral surfaces, a longitudinal opening (10) through which an inner support (3) of fixing element (90) can be slidingly inserted within said casing (2) in an assembled condition (A) of magazine (1); the inner support (3) includes:

a guide (8) fit for slidably housing the fixing element (90);

a pusher (4) for said fixing elements (90) movable on said guide (8), a second flat and elongated head (5) fixed to an end of the guide (8), fit for mating in the assembled condition (A) to the first head (4);

an engagement element (6) fixed to a remaining end of the guide (8) for locking the inner support (3) to the pneumatic gun (100);

said magazine (1) being characterized in that the guide (8) includes at least an elongated base element (27) and a supporting rib (28) which is provided with a supporting portion (27*b*) fit for housing corresponding fixing elements (90) with predefined size; said supporting rib (28), second head (5) and engagement element (6) being removably coupled to said based element (27), the first head (14) being removably couple to said base element (27), the first head (14) being removably coupled to the casing (2), the based element (27) having folded longitudinal edges firming fins (27*a*) fit to be inserted in complementary slots (13) carried out at edges (12) of the longitudinal opening (10) of the casing (2).

2. The magazine as claimed in claim 1 wherein the supporting rib (28) comprises a longitudinal protruding portion (28*a*) fit to engage a complementary longitudinal seat (27*b*) of base element (27).

3. The magazine as claimed in claim 2 wherein the longitudinal protruding portion (28*a*) and the longitudinal seat (27*b*) of the base element (27) have complementary shaped sections to form a dap joint.

4. The magazine as claimed in claim 3 wherein the supporting rib (28) is removably locked to the base element (27) by coupling the engagement element (6) and the first bead (14) to said base element (27).

5. The magazine as claimed in claim 1 wherein the first head (14), which is orthogonal with respect to casing (2), has an inner face (14*a*) facing the casing (2) provided with a flat incision (17) whose width corresponds to the width of fixing elements (90) of a predefined size, and which forms with the second head (28) in the assembled condition (A) a firing channel (17*a*) for said fixing elements (90).

6. The magazine as claimed in claim 1 wherein the pusher (4) has a U-like shape in order to straddle the supporting portion (28*b*) of the supporting rib (28) and in the assembled condition (A), the pusher is biased towards the second head (28) by elastic means (62) connected to the engagement element (6).

7. The magazine as claimed in claim 6 wherein the supporting portion (28*b*) comprises a longitudinal slit (29) that passes through the supporting rib (28) from one end to the other and which contains at least the elastic means (62).

8. The magazine as claimed in claim 7 wherein said elastic means (62) comprise at least a fraction spring, whose ends are fixed respectively to the pusher (4) and to a hook means (63) interposed between the supporting rib (28) and the engagement element (6), said fraction spring (62) being wound on a guiding wheel (64) engaging a slot (33) of the supporting rib (28).

9. The magazine as claimed in claim 7 wherein said elastic means (62) comprise at least a traction spring, whose ends are fixed respectively to the pusher (4) and to a hook means (63) interposed between the supporting rib (28) and the engagement element (6), said traction spring (62) being wound on a guiding wheel (64) engaging a slot (33) of the supporting rib (28).

10. The magazine as claimed in claim 1 wherein the supporting rib (28), the second head (28), the engagement element (6) and the first head (14) arc removably coupled-respectively to the base element (27) and to the casing (2) by fixing means (50,51,52, 15).

11. The magazine as claimed in claim 1 wherein said second head (5) comprises a first projection (40) and a second projection (41) orthogonally protruding with respect to the head and forming therebetween a slit (42), the second projection (41) engaging a recess (30) of the supporting rib (28), the slit (42) engaging an end portion (27*c*) of the base element (27).

12. The magazine as claimed in claim 1 wherein the supporting rib (28), the second head (28), the engagement element (6) and the first head (14) are removably coupled respectively to the base element (27) and to the easing (2) by fixing means (50, 51, 52, 15).

13. An improved modular magazine of fixing elements for a pneumatic gun (100), comprising an elongated casing (2), which is parallelepiped shaped and internally hollow, fit to be removably coupled tote pneumatic gun (100); the easing (2) has, at one end, a first flat and elongated head (14), the remaining end being open, and at one of the lateral surfaces, a longitudinal opening (10) through which an inner support (3) of fixing element (90) can be slidingly inserted within said casing (2) in an assembled condition (A) of magazine (1); the inner support (3) includes:

a guide (8) fit for slidably housing the fixing element (90);

a pusher (4) for said fixing elements (90) movable on said guide (8), a second flat and elongated head (5) fixed to an end of the guide (8), fit for mating in the assembled condition (A) to the first head (4);

an engagement element (6) fixed to a remaining end of the guide (8) for locking the inner support (3) to the pneumatic gun (100);

said magazine (1) being characterized in that the guide (8) includes at least an elongated base element (27) and a supporting rib (28) which is provided with a supporting portion (27*b*) fit for housing corresponding fixing elements (90) with predefined size; said supporting rib (28), second head (5) and engagement element (6) being removably coupled to said based element (27), the first head (14) being removably couple to said base element (27), the first head (14) being removably coupled to the casing (2), said second head (5) having a first projection (40) and a second projection (41) orthogonally protruding wit respect to the head and forming therebetween a slit (42), the second protection (41) engaging a recess (30) of the supporting rib (28), the silt (42) engaging an end portion (27*c*) of the base element (27).

14. The magazine as claimed in claim 13 wherein the supporting rib (28) comprises a longitudinal protruding portion (28*a*) fit to engage a complementary longitudinal seat (27*b*) of base element (27).

15. The magazine as claimed in claim 14 wherein the longitudinal protruding portion (28*a*) and the longitudinal seat (27*b*) of the base element (27) have complement&y shaped sections to form a dap joint.

16. The magazine as claimed in claim 15 wherein the supporting rib (28) is removably locked to the base element (27) by coupling the engagement element (6) and the first head (14) to said base element (27).

17. The magazine as claimed in claim 13 wherein the first head (14), which is orthogonal with respect to casing (2), has an inner face (14*a*) facing the casing (2) provided with a flat incision (17) whose width corresponds to the width of fixing elements (90) of a predefined size, and which forms with the second head (28) in the assembled condition (A) a firing channel (17*a*) for said fixing elements (90).

18. The magazine as claimed in claim 13 wherein the pusher (4) has a U-like shape in order to straddle the supporting portion (28*b*) of the supporting rib (28) and in the assembled condition (A), the pusher is biased towards the second head (28) by elastic means (62) connected to the engagement element (6).

19. The magazine as claimed in claim 18 wherein the supporting portion (28*b*) comprises a longitudinal slit (29) that passes through the supporting rib (28) from one end to the other and which contains at least the elastic means (62).

20. The magazine as claimed in claim 13 wherein the supporting rib (28), the second head (28), the engagement element (6) and the first head (14) are removably coupled-respectively to the base element (27) and to the casing (2) by fixing means (50,51,52, 15).

21. An improved modular magazine of fixing elements for a pneumatic gun (100), comprising an elongated casing (2), which is parallelepiped shaped and internally hollow, fit to be removably coupled to the pneumatic gun (100); the casing (2) has, at one end, a first flat and elongated head (14), the remaining end being open, and at one of the lateral surfaces, a longitudinal opening (10) through which an inner support (3) of fixing element (90) can be slidingly inserted within said casing (2) in an assembled condition (A) of magazine (1); the inner support (3) includes:

a guide (8) fit for slidably housing the fixing element (90);

a pusher (4) for said fixing elements (90) movable on said guide (8), a second flat and elongated head (5) fixed to an end of the guide (8), fit for mating in the assembled condition (A) to the first head (4);

an engagement element (6) fixed to a remaining end of the guide (8) for looking the inner support (3) to the pneumatic gun (100);

said magazine (1) being characterized in tat the guide (8) includes at least an elongated base element (27) and a supporting rib (28) which is provided wit a supporting portion (27*b*) fit for housing corresponding fixing elements (90) wit predefined size; said supporting rib (28), second head (5) and engagement clement (6) being removably coupled to said based element (27), the first head (14) being removably couple to said base element (27), the first head (14) being removably coupled to the casing (2), the supporting rib (28) having a longitudinal protruding portion (28*a*) for engaging a complementary longitudinal seat (27*b*) of the base element (27), the longitudinal protruding portion (28*a*) and the longitudinal seat (27*b*) of the base element (27) having complementary shaped sections to form a dap joint, the supporting rib (28) being removably locked to the base element (27) by coupling the engagement element (6) and the first head (14) to said base element (27).

22. The magazine as claimed in claim 21 wherein the supporting rib (28), the second head (28), the engagement element (6) and the first head (14) are removably coupled respectively to the base element (27) and to the casing (2) by fixing means (50, 51, 52, 15).

23. An improved modular magazine of fixing elements for a pneumatic gun (100), comprising an elongated casing (2), which is parallelepiped shaped and internally hollow, fit to be removably coupled to the pneumatic gun (100); the casing (2) has, at one end, a first flat and elongated head (14), the remaining end being open, and at one of the lateral surfaces, a longitudinal opening (10) through which an inner support (3) of fixing element (90) can be slidingly inserted within said casing (2) in an assembled condition (A) of magazine (1); the inner support (3) includes:

a guide (8) fit for slidably housing the fixing element (90);

a pusher (4) for said fixing elements (90) movable on said guide (8), a second flat and elongated head (5) fixed to an end of the guide (8), fit fir mating in the assembled condition (A) to the first head (4);

an engagement element (6) fixed to a remaining end of the guide (8) for locking the inner support (3) to the pneumatic gun (100);

said magazine (1) being characterized in that the guide (8) includes at least an elongated base element (27) and a supporting rib (28) which is provided with a supporting portion (27*b*) fit for housing corresponding fixing elements (90) with predefined size; said supporting rib (28), second head (5) and engagement element (6) being removably coupled to said based element (27), the first head (14) being removably couple to said base element (27), the first head (14) being removably coupled to the casing (2), the pusher (4) having a U-shape in order to straddle the supporting portion (28*b*) of the supporting rib (28) and in the assembled condition (A) being biased towards the second head (28) by elastic means (62) connected to the engagement element (6), the supporting portion (28*b*) having a longitudinal slit (29) that passes through the supporting rib from one end to the other end and which contains at least the elastic means (62), said elastic means (62) comprising at least a traction spring, whose ends are fixed respectively to the pusher (4) and to a hook means (63) interposed between the supporting rib (28) and the engagement element (6), said traction spring (62) being wound on a guiding wheel (64) and engaging a slot (33) of the supporting rib (28).

* * * * *